US008771831B2

(12) United States Patent
Winterhalter

(10) Patent No.: US 8,771,831 B2
(45) **Date of Patent: *Jul. 8, 2014**

(54) MULTI-FUNCTIONAL YARNS AND FABRICS HAVING ANTI-MICROBIAL, ANTI-STATIC AND ANTI-ODOR CHARACTERISITICS

(75) Inventor: Carole A. Winterhalter, Marlborough, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 520 days.

This patent is subject to a terminal disclaimer.

(21) Appl. No.: 11/315,384

(22) Filed: Dec. 23, 2005

(65) Prior Publication Data

US 2007/0148449 A1 Jun. 28, 2007

(51) Int. Cl.
*D02G 3/02* (2006.01)

(52) U.S. Cl.
USPC ..... 428/357; 428/364; 428/377; 428/919; 442/110; 442/123; 442/60; 442/131

(58) Field of Classification Search
USPC ..... 2/239; 8/115.51, 188, 116.1, 115.6, 8/115.5; 28/281; 29/527.2; 34/597; 55/DIG. 43, 526, 360; 57/362, 905, 57/901, 350, 295, 230, 227, 210, 208, 207, 57/232–258; 66/178 R, 202, 185, 171; 106/1.19, 1.18, 1.14, 1.13; 139/425 R; 210/764, 758; 252/8.82, 8.63, 8.61; 422/301, 181, 167, 164, 130; 424/443, 424/405, 404; 427/412, 392, 389.9, 247, 427/245, 244, 243, 2.31, 78.35, 78.34, 427/78.08, 724, 635, 619, 618, 490, 449, 427/443, 421, 411, 409, 407, 406, 405, 404, 427/403, 402, 1.29; 428/96, 95, 92, 87, 428/608, 377, 375, 373, 372, 370, 362, 361, 428/359, 97, 922, 921, 920, 91, 907, 90, 85, 428/400, 397, 395, 394, 389, 379, 374, 369, 428/368, 365, 364, 342, 341, 340, 324, 357, 428/919; 442/96, 302, 197, 190, 123, 76, 442/310, 308, 304, 301, 231, 228, 217, 209, 442/208, 203, 200, 199, 198, 193, 191, 189, 442/181, 179, 128, 124, 110, 60, 131; 510/515; 514/495; 524/606, 605, 440, 524/439, 403

See application file for complete search history.

(56) References Cited

U.S. PATENT DOCUMENTS 4,120,914 A * 10/1978 Behnke et al. ..... 525/432
4,758,465 A * 7/1988 McKinney et al. ..... 442/139

(Continued)

FOREIGN PATENT DOCUMENTS

CA 2517070 A1 * 10/2004
JP 10310976 A * 11/1998

OTHER PUBLICATIONS

X-Static Fiber Technical Information archived by Way Back Internet Archive on Nov. 25, 2004. http://web.archive.org/web/20041109112556/www.x-staticfiber.com/index3.htm.*

(Continued)

*Primary Examiner* — Elizabeth Cole
(74) *Attorney, Agent, or Firm* — Roger C. Phillips

(57) ABSTRACT

The present invention is directed to yarns and fabrics that exhibit anti-static, anti-odor, and anti-microbial properties. The yarn is comprised of several groups of predetermined fibers. One of these groups of predetermined fibers comprises fibers that exhibit anti-microbial, anti-odor and anti-static characteristics. In one embodiment, the yarn comprises a first plurality of fibers, a second plurality of fibers that are different from the fibers of the first plurality, and a third plurality of fibers that are different from the fibers of the first and second pluralities. In one embodiment, the fibers which exhibit anti-microbial, anti-odor and anti-static properties are metallic coated fibers. Other fibers used to form different embodiments of the yarns include cotton, nylon, polyester, wool, meta-aramid fibers, para-aramid fibers, and stretch fibers.

4 Claims, 2 Drawing Sheets

(56) References Cited

U.S. PATENT DOCUMENTS

| | | | | |
|---|---|---|---|---|
| 4,988,746 | A * | 1/1991 | Tanaka et al. | 524/12 |
| 5,180,585 | A * | 1/1993 | Jacobson et al. | 424/405 |
| 5,527,597 | A * | 6/1996 | Stanhope et al. | 442/184 |
| 5,840,425 | A * | 11/1998 | Hodan | 428/372 |
| 5,856,005 | A * | 1/1999 | Gurian | 428/370 |
| 5,952,099 | A * | 9/1999 | Asher et al. | 428/370 |
| 6,037,057 | A | 3/2000 | Hartzog | |
| 6,057,032 | A * | 5/2000 | Green | 428/359 |
| 6,132,866 | A * | 10/2000 | Nelson et al. | 428/359 |
| 6,196,156 | B1 | 3/2001 | Denesuk | |
| 6,228,491 | B1 | 5/2001 | Antelman | |
| 6,374,643 | B2 | 4/2002 | Orima | |
| 6,432,850 | B1 * | 8/2002 | Takagi et al. | 442/190 |
| 6,451,144 | B2 | 9/2002 | Williamson | |
| 6,474,367 | B1 | 11/2002 | Jayaraman et al. | |
| 6,540,792 | B1 * | 4/2003 | Ishii et al. | 8/115.51 |
| 6,592,702 | B2 | 7/2003 | Nickell | |
| 6,602,811 | B1 | 8/2003 | Rock | |
| 6,723,428 | B1 * | 4/2004 | Foss et al. | 428/370 |
| 6,770,581 | B1 | 8/2004 | DeMott | |
| 6,841,244 | B2 | 1/2005 | Foss | |
| 6,946,412 | B2 * | 9/2005 | Campbell et al. | 442/302 |
| 2001/0009832 | A1 * | 7/2001 | Shaffer et al. | 442/181 |
| 2002/0136859 | A1 * | 9/2002 | Fisher et al. | 428/95 |
| 2002/0146950 | A1 * | 10/2002 | Reich | 442/96 |
| 2003/0171050 | A1 * | 9/2003 | Eichhorn et al. | 442/301 |
| 2004/0209051 | A1 * | 10/2004 | Santos et al. | 428/195.1 |
| 2004/0237494 | A1 * | 12/2004 | Karayianni et al. | 57/212 |
| 2006/0068664 | A1 * | 3/2006 | Gibson et al. | 442/197 |

OTHER PUBLICATIONS

Paul, Sarah-Leigh. "New safety overalls developed for oil refinery workers." Engineering News Sep. 9, 2005, 2 pages.*

MIL-C-83429B, Military Specification: Cloth, Plain and Basket Weave, Aramid (Sep. 26, 1990).*

Development of the U.S. Woodland Battledress Uniform, by Ramsley and Bushnell, U.S Army Natick Research and Development Laboratories, Natick MA, Natick/TR-81/008, Jan. 1981.

Development of Combat Uniform Fabrics Exhibiting Durable Electrostatic Dissipation Properties, by Winterhalter, Natick/TR-02/009; U.S. Army Natick Research, Development and Engineering Center, 2002.

Experimental Battledress Uniform Fabrics Made from Amine Oxide Solvent Spun Cellulosic Fibers, by Winterhalter, Natick/TR-02/007, U.S. Army Natick Soldier Systems Center, Natick, MA, 2002.

Characterization of the Ultraviolet Protection of Combat Uniform Fabrics, by Winterhalter et al.; NATICK/TR-02/006. Natick, MA: U.S. Army Natick Soldier Systems Center 2002.

Development of Cloth Camouflage, Universal Pattern, Flame Resistant, Wool/Nomex Blend , by Mehta, et al., Natick/TR-08/019, U.S. Army Natick Research, Development and Engineering Center, 2008.

Military Fabrics for Flame Protection, by Winterhalter, pp. 326-345, Military Textiles, ed. E. Wilusz, Woodhouse Publishing, 2008.

* cited by examiner

MULTI-FUNCTIONAL YARNS AND FABRICS HAVING ANTI-MICROBIAL, ANTI-STATIC AND ANTI-ODOR CHARACTERISITICS

STATEMENT OF GOVERNMENT INTEREST

The invention described herein may be manufactured and used by the U.S. Government for Governmental purposes without the payment of any royalties thereon.

BACKGROUND OF THE INVENTION

1. Field of the Invention

The present invention generally relates to yarns and fabrics.

2. Description of the Related Art

Prior art fabrics used to manufacture military combat uniforms are typically made from yarns that are comprised of a staple blend of cotton and nylon fibers. This blend of cotton and nylon fibers supports dyeing and printing techniques that use a combination of acid and vat dyes to impart a camouflage pattern. This camouflage pattern provides both visual and near infrared camouflage protection. The aforesaid yarns made from the blend of cotton and nylon fibers are combined with lightweight, thin fabric construction to produce fabrics that provide comfort, durability, and UV resistance. Other fabrics, such as flame-retardant fabrics, are made from blends of NOMEX® synthetic fiber meta-aramid fiber, KEVLAR® synthetic fiber para-aramid fiber, and P140 electrostatic dissipative fiber, and also provide a level of visual and near infrared camouflage protection. However, these aforesaid prior art fabrics do not provide anti-odor, anti-microbial, or electrostatic dissipation performance in a single, complete fabric.

Prior art techniques have provided underwear or undergarments having anti-static and/or anti-odor and/or anti-microbial agents. These undergarments are worn under the military BDU (Battledress Uniform) or ACU (Advanced Combat Uniform). However, the practice of wearing undergarments under the outer military uniform increases heat stress on the wearer and creates great discomfort. In relatively hot environments, such as the tropics or desert, many soldiers do not wear underwear underneath their BDU or ACU. The underwear contributes to increased heat stress and discomfort. In addition, soldiers usually do not have access to clean underwear. Furthermore, soldiers lack the space to store clean underwear since in battlefield situations, clothing is typically a low-priority item compared with munitions, fuel, food and water. Thus, soldiers typically have only the clothes on their back. Furthermore, soldiers do not want to wear the same close-fitting, dirty underwear on a daily or weekly basis and therefore, choose not to wear underwear or undergarments.

Other prior art techniques include treating combat uniform fabrics with anti-microbial treatments. However, some of these prior art treatments are not durable and wear out after repeated laundering.

New yarns and fabrics are needed in order to address the deficiencies and problems associated with prior art protective clothing and related prior art techniques for making such clothing.

SUMMARY OF THE INVENTION

Bearing in mind the problems and deficiencies of the prior art clothing and techniques, it is an object of the present invention to provide yarns and fabrics that exhibit anti-microbial or anti-bacterial properties.

It is another object of the present invention to provide yarns and fabrics that exhibit anti-odor properties which substantially prevent the production of body odor.

It is a further object of present invention to provide yarns and fabrics that exhibit anti-static properties.

Thus, the present invention is directed to multi-functional yarns and fabrics that (1) exhibit anti-static, anti-odor and anti-microbial (or anti-bacterial) properties, and (2) can be used to make a stand-alone garment that performs the functions of separate garments. A significant advantage of the yarns and fabrics of the present invention is that these yarns and fabrics eliminate the need for separate undergarments, underwear, or inner layers of clothing, while still providing anti-microbial, anti-odor and anti-static functions. The yarns and fabrics of the present invention can be used to fabricate a single, stand-alone garment that is suitable for hot-weather environments such as the tropics or desert, or a single, stand-alone garment that is suitable for cold weather environments.

Thus, in one aspect, the present invention is directed to a yarn that comprises a blend of a plurality of fibers that include a plurality of fibers which exhibit anti-microbial, anti-static and anti-odor characteristics. In one embodiment, the yarn comprises a blend of a plurality of nylon fibers, a plurality of cotton fibers, and the plurality of fibers having anti-microbial, anti-static and anti-odor properties. This blend may also contain a plurality of stretch fibers. In an alternate embodiment, this yarn comprises a blend of a plurality of polyester fibers, a plurality of cotton fibers, and a plurality of fibers having anti-microbial, anti-static and anti-odor properties. This blend may also contain a plurality of stretch fibers. In a further embodiment, this yarn comprises a blend of a plurality of NOMEX® synthetic fiber meta-aramid fibers, a plurality of KEVLAR® synthetic fiber para-aramid fibers, and the plurality of fibers having anti-microbial, anti-static and anti-odor characteristics. This blend may also contain a plurality of stretch fibers.

In another aspect, the present invention is directed to a yarn comprising a blend of a plurality of NOMEX® synthetic fiber meta-aramid fibers, a plurality of KEVLAR® synthetic fiber para-aramid fibers, a plurality of wool fibers, and a plurality of fibers having anti-microbial, anti-static and anti-odor characteristics. This blend may also contain a plurality of stretch fibers.

In all of the foregoing embodiments, it is preferred that the fibers which exhibit the anti-microbial, anti-odor and anti-static properties are configured as metallic-coated fibers. In one embodiment, this metallic coating is a silver coating.

The present invention also encompasses fabrics made at least in part from the yarns described in the foregoing description.

Other objects, features, benefits and advantages of the present invention will be apparent from the ensuing description.

BRIEF DESCRIPTION OF THE DRAWINGS

The foregoing features of the present invention will become more readily apparent and may be understood by referring to the following detailed description of illustrative embodiments of the present invention, taken in conjunction with the accompanying drawings, in which.

DESCRIPTION OF THE PREFERRED EMBODIMENTS

The present invention is directed to yarns and fabrics that exhibit anti-static, anti-odor and anti-microbial characteristics. Although the ensuing description is in terms of the aforesaid yarns and fabrics being used to fabricate military clothing and garments, it is to be understood that these yarns and fabrics can be used to fabricate other types of protective clothing for personnel in other fields, e.g. medical, construction, petroleum, hazardous waste, chemical, etc. Furthermore, the yarns and fabrics of the present invention can also be used to fabricate protective recreational and sports clothing.

In accordance with the invention, predetermined types of fibers are blended together to form yarns which are used to fabricate clothing that exhibits anti-microbial, anti-static, and anti-odor characteristics. In a preferred embodiment, the fibers are military grade fibers. Several embodiments of the present invention are now discussed in detail.

Figure 1:
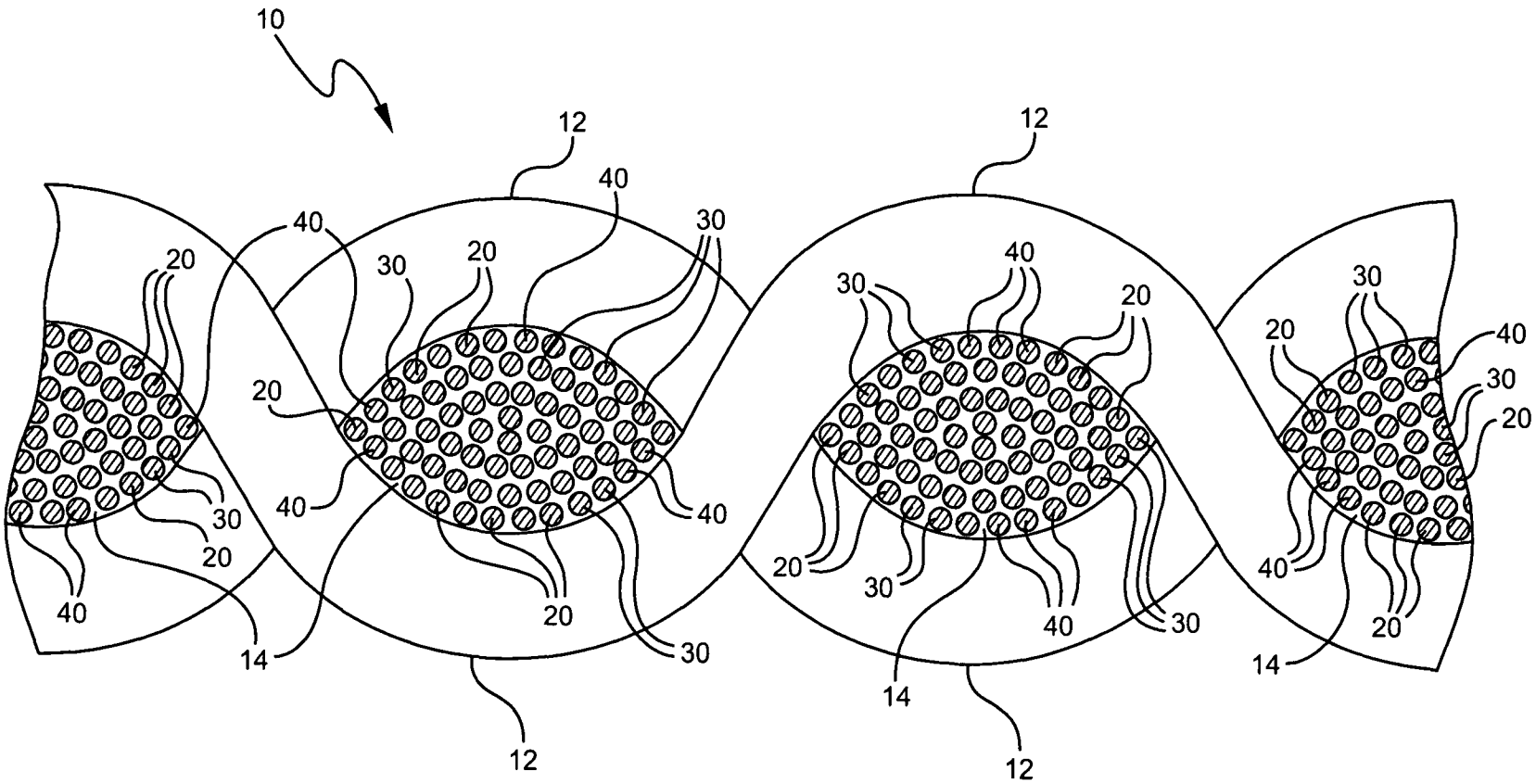
FIG. 1 is a partial, cross-sectional view of a woven fabric in accordance with one embodiment of the present invention.

Referring to FIG. 1, there is shown a cross-sectional view of the basic configuration of a woven fabric in accordance with one embodiment of the present invention. Woven fabric 10 generally comprises warp yarns 12 and filling yarns 14. Warp yarns 12 and filling yarns 14 are arranged in a generally criss-cross configuration. FIG. 1 is only a partial view and therefore, only portions of some of the warp yarns 12 and filling yarns 14 are shown. Each filling yarn 14 comprises a plurality of fibers 20, 30 and 40 that are blended together.

As will be shown by the ensuing description of several embodiments of the present invention, each fiber 20 and 30 can be any one of several preferred fibers, and each fiber 40 is a fiber that exhibits anti-microbial, anti-static and anti-odor properties. Thus, fibers 20, 30 and 40 are blended together to provide a fabric that has anti-microbial, anti-static, and anti-odor characteristics in accordance with the invention.

In accordance with one embodiment of the present invention, each fiber 20 is a nylon fiber, each fiber 30 is a cotton fiber, and each fiber 40 is a metal-coated fiber that exhibits anti-microbial, anti-odor and anti-static properties. In a preferred embodiment, each fiber 40 comprises a fiber having a metallic layer on the surface thereof. Preferably, fibers 40 are configured as Noble Fiber X-STATIC® synthetic fibers. The aforesaid X-STATIC® synthetic fiber is a fiber having a layer of silver coated over the surface thereof. Sauquoit Industries, of Scranton, Pa., manufactures X-STATIC® synthetic fibers and markets such fibers as X-STATIC I® and X-STATIC II® synthetic fibers. X-STATIC® synthetic fibers have excellent anti-bacterial, anti-odor, electromagnetic shielding and electrostatic dissipation properties. However, it is to be understood that other suitable fibers that exhibit anti-bacterial, anti-odor and anti-static properties may also be used. In another embodiment, fibers 40 are configured as copper coated fibers.

In one embodiment, each filling yarn 14 has the following percentages of fibers shown in Table I:

TABLE I

| | |
|---|---|
| Nylon | 49% |
| Cotton | 46% |
| X-Static ® | 5% |

However, these percentages are just examples and can be varied. Preferably, there is at least 5% of X-STATIC® synthetic fibers. Fibers 20, 30 and 40 are blended together by any suitable method or technique, and then are woven, knitted, braided or fabricated by a non-woven process, to form a fabric or cloth. The fabric or cloth is then subsequently dyed and/or printed, or the fibers can be blended with dyed fibers prior to fabric formation. In the case of a military combat uniform, the finished fabric or cloth is usually printed with a camouflage design. It is to be understood that each warp yarn 12 also can be configured to have a blend of the same fibers used to form filling yarns 14.

In another embodiment, each fiber 20 is a NOMEX® synthetic fiber meta-aramid fiber, each fiber 30 is a KEVLAR® synthetic fiber para-aramid fiber, and each fiber 40 is a fiber that exhibits anti-microbial, anti-odor and anti-static properties. In a preferred embodiment, each fiber 40 is configured as the aforementioned X-STATIC® synthetic fiber. In one embodiment, each filling yarn 14 has the percentages of fibers shown in Table II:

TABLE II

| | |
|---|---|
| Nomex | 90% |
| Kevlar | 5% |
| X-Static ® | 5% |

However, these percentages are just examples and can be varied. These fibers can be blended together by any of the aforementioned methods or techniques to form a fabric. The fabric is then subsequently dyed and/or printed, or the fibers can be blended with dyed fibers prior to fabric formation. In the case of a military combat uniform, the finished fabric or cloth is usually printed with a camouflage design. Warp yarns 12 may be formed from the blend of the same fibers used to form filling yarns 14 in this embodiment.

In a further embodiment, each fiber 20 is a polyester fiber, each fiber 30 is a cotton fiber, and each fiber 40 is the preferred X-STATIC® synthetic fiber. In one embodiment, each filling yarn 14 has the percentages of fibers shown in Table III:

TABLE III

| | |
|---|---|
| Polyester | 50% |
| Cotton | 45% |
| X-Static | 5% |

However, these percentages are just examples and can be varied. These fibers can be blended together by any of the aforementioned methods or techniques to form a fabric. The fabric can then be subsequently dyed and/or printed, or the fibers can be blended with dyed fibers prior to fabric formation. In the case of a military combat uniform, the finished fabric is usually printed with a camouflage design. Warp yarns 12 may also be formed from this particular blend of fibers.

Figure 2:
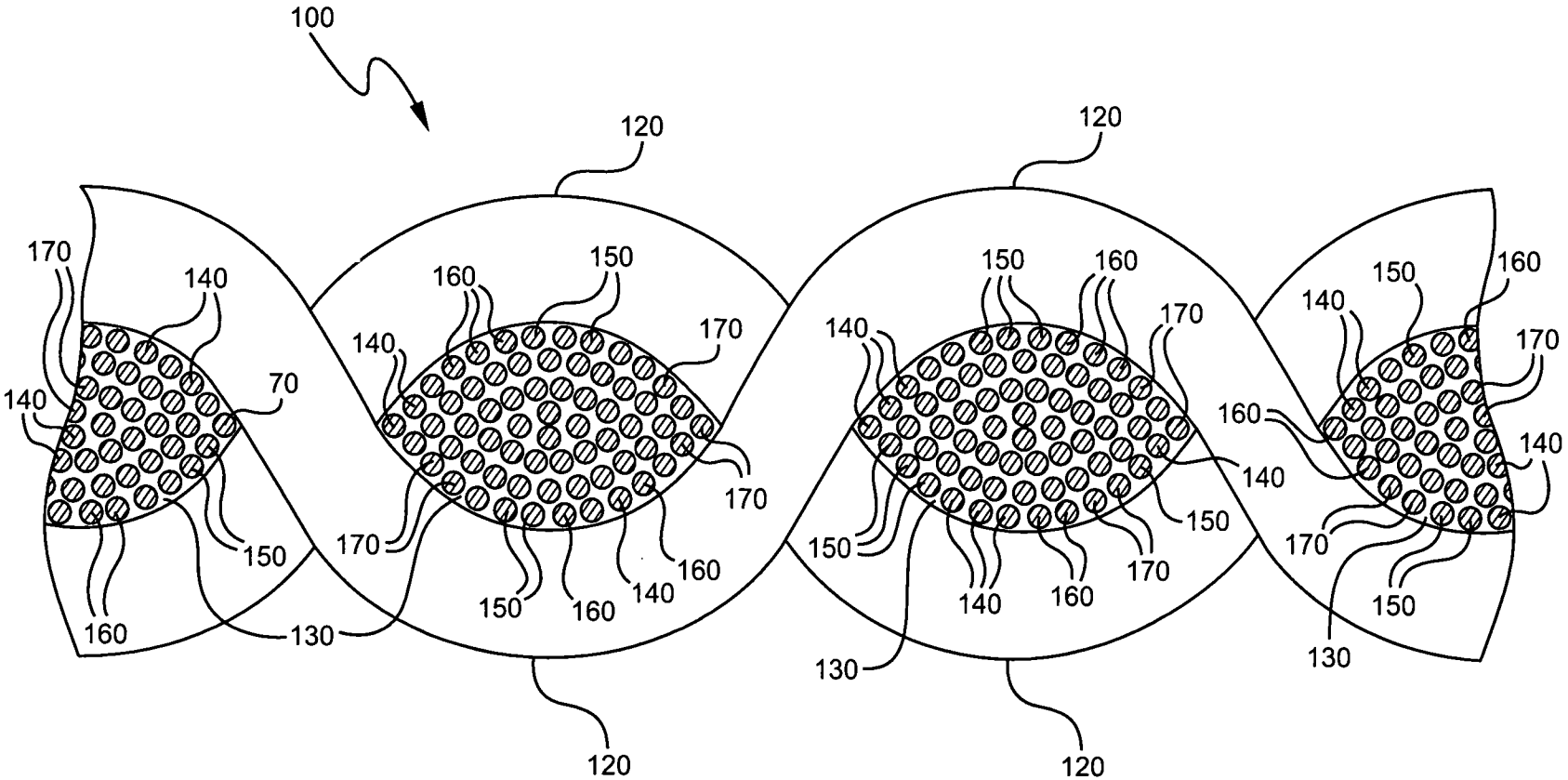
FIG. 2 is a partial, cross-sectional view of a woven fabric in accordance with another embodiment of the present invention.

Referring to FIG. 2, there is shown woven fabric 100 in accordance with another embodiment of the present invention. Fabric 100 generally comprises warp yarns 120 and filling yarns 130. Warp yarns 120 are arranged in a generally criss-cross relationship with filling yarns 130. Each filling yarn 130 comprises a plurality of fibers 140, 150, 160 and 170. Fibers 140, 150, 160 and 170 are blended together to provide a garment having anti-microbial, anti-static, and anti-odor properties. In one embodiment, fibers 140 are NOMEX® synthetic meta-aramid fibers, fibers 150 are KEVLAR® synthetic para-aramid fibers, fibers 160 are wool fibers, and fibers 170 are fibers that exhibit antimicrobial, anti-static and anti-odor properties. In a preferred embodiment, fibers 170 are the aforementioned X-STATIC® synthetic fibers. In one embodiment, each filling yarn 130 comprises the percentages of fibers shown in Table IV:

TABLE IV

| | |
|---|---|
| Nomex | 40% |
| Kevlar | 5% |
| Wool | 50% |
| X-Static ® | 5% |

Preferably, a stretch fiber is preferably added to each of the blends described in the foregoing description. In one embodiment, the stretch fiber may be LYCRA®spandex fiber. In another embodiment, the stretch fiber may be XLA® Lastol fiber manufactured by Dow Chemical. Other suitable stretch fibers may be used.

These percentages are just examples and may be varied. Fibers 140, 150, 160 and 170 are blended together, and any of the methods or techniques described above, e.g. weaving, knitting, etc., may be used to form a fabric. The fabric is then dyed and/or printed, or blended with dyed fibers prior to fabric formation. In the case of a military combat uniform, the finished fabric is usually printed with a camouflage design. Each warp yarn 120 can be formed from this same blend of fibers which is used to form filling yarns 130.

Although particular apparel-grade fibers have been described above, such as cotton, polyester, nylon, and wool, other suitable apparel-grade fibers can be used as well, e.g. DACRON® synthetic fiber, Rayon fiber etc. High-quality silk can also be used as one of the fibers.

With respect to all of the embodiments described in the foregoing description, X-STATIC II® synthetic fiber (conductive grade) yarn optionally can be alternated or spaced between the fibers of the warp yarns and filling yarns to support electronic textile applications. In order to insulate the aforesaid fibers, prevent shorts and reduce fraying, the conductive yarns are coated or treated with a protective layer such as polyurethane and silicone. In another embodiment, the conductive yarn is buried within a plied or plated yarn structure. In a further embodiment, the conductive yarn is embedded within a fabric structure of all three yarns, i.e. coated, plated and embedded within a fabric structure. The finished fabric provides conductivity when the conductive yarns are integrated into a continuous fabric pathway.

The warp and filling yarns described in the foregoing description can be fabricated into any type of fabric for use in any type of garment such as, but not limited to, shirts, pants, shorts, jackets, underwear, socks, etc. These fabrics may be subsequently treated with permanent press, and/or soil-release finishes for easy care and low maintenance. The fabric can also be subsequently treated with water and/or oil repellants and insect repellants.

In a preferred embodiment, the filling yarns are fabricated with any one of the fiber blends described in the foregoing description since in certain fabric constructions, it is the filling yarns that mostly contact the wearer's skin. However, as shown by the foregoing description, the warp yarns can also be fabricated with the same blend of fibers used to form the filling yarns. Thus, in one embodiment, only the filling yarns are fabricated with any one of the blends of fibers described in the foregoing description. In another embodiment, only the warp yarns are fabricated with any one of the blends of fibers described in the foregoing description. In a further embodiment, both the warp and filling yarns are fabricated with any one of the blends of the fibers described in the foregoing description. In yet a further embodiment, the warp yarn is formed from one of the blends of fibers described herein, and the filling yarn is formed from another, different blend of fibers described herein.

In a preferred embodiment, the denier of the fibers used to form the filling and warp yarns is in a range of between about 1.8 and 2.5 denier. Preferably, the denier of the filling yarn fibers is substantially equal to the denier of the warp yarn fibers. Such a configuration facilitates the transport of liquid moisture which collects on the filling yarns to the warp yarns. Thus, when the denier of the filling yarn fibers is equal to the denier of the warp yarn fibers, the inter-fiber space in the filling yarn is also equal to the inter-fiber space in the warp yarns. As a result, when moisture collects on the filling yarns, this moisture is quickly transferred from the filling yarns to the warp yarns due to capillary action.

Thus, fabrics fabricated with the warp and filling yarns of the present invention provide multi-functionality including visual and near infrared protection, comfort, durability, UV resistance, electrostatic dissipation, anti-odor performance, and anti-microbial performance.

The present invention provides many advantages and benefits over prior techniques and methods. For example, clothing made from fabrics fabricated with the warp and filling yarns of the present invention provide anti-static, anti-odor, and anti-microbial performance thereby eliminating the need for separate, additional undergarments or underwear. The yarns of the present invention can be used to fabricate clothing that can be used as (i) undergarments in a layered clothing system for cold weather environments, (ii) a single, stand-alone garment for use in cold weather environments, and (iii) a single, stand-alone garment for use in hot weather environments. Thus, rather than having multiple garments, each providing a specific function, the present invention provides clothing composed of a single fabric that provides multi-functional performance, the desired anti-microbial, anti-static and anti-odor characteristics, improved durability and relatively longer wear-life.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the invention. Accordingly, the foregoing detailed description should be considered as exemplary in nature and not limiting the scope and spirit of the invention as set forth in the attached claims.

What is claimed is:

1. A yarn for forming a fabric having anti-microbial, anti-static, and anti-odor characteristics, said yarn comprising:

a plurality of meta-aramid fibers, said meta-aramid fibers being about 45% by weight of the yarn;

a plurality of para-aramid fibers, said para-aramid fibers being about 5% by weight of the yarn;

a plurality of silver coated fibers for supporting electronic textile applications, said silver coated fibers configured to exhibit anti-microbial, anti-static, and anti-odor properties, said silver coated fibers being about 5% by weight of the yarn;

a plurality of wool fibers, said wool fibers being about 45% by weight of the yarn; and a plurality of stretch fibers;

wherein said fabric is dyed and/or printed to a selected coloration, or said fibers are blended with dyed fibers prior to forming said fabric; and wherein said yarn for use in making clothing, including a camouflage pattern for protection from visual and near infrared radiation, said clothing including a stand-alone garment, said stand-alone garment performing functions of separate garments, said separate garments comprising undergarments, underwear, or inner layers.

2. A fabric formed at least in part by the yarn defined by claim 1.

3. The yarn according to claim 1, wherein the yarn is formed into the fabric by a process selected from the group consisting of weaving, non-woven, and knitting; wherein the fabric is treated by a process selected from the group consisting of insect repellant, water repellant, oil repellant, permanent press, and soil release; wherein the fabric is camouflage printed directly onto the fabric; and wherein said metal-coated fibers are coated with a protective layer for insulating any fibers from a short-circuit.

4. A fabric in accordance with claim 3, wherein said protective layer is selected from a group consisting of polyurethane and silicone.

* * * * *